United States Patent [19]

Hanson

[11] 4,083,127

[45] Apr. 11, 1978

[54] ADJUSTABLE, PRESSURE-COMPENSATING, CUSTOM FITTING PADS HAVING PREDETERMINED AMOUNT OF FITTING MATERIAL AND THEIR USE IN BOOTS

[75] Inventor: Chris A. Hanson, Boulder, Colo.

[73] Assignee: Hanson Industries Incorporated, Boulder, Colo.

[21] Appl. No.: 778,828

[22] Filed: Mar. 17, 1977

[51] Int. Cl.[2] ..... A43B 7/14; A43B 19/00; A43B 5/04

[52] U.S. Cl. ..... 36/93; 36/117; 36/71

[58] Field of Search ..... 36/71, 93, 88, 96, 117, 36/118, 119, 120, 121, 29, 35 B; 5/348 R, 348 WB

[56] References Cited

U.S. PATENT DOCUMENTS

| | | | |
|---|---|---|---|
| 1,148,376 | 7/1915 | Gay | 36/29 |
| 3,760,056 | 9/1973 | Rudy | 36/93 |
| 3,820,255 | 6/1974 | Davis | 36/93 |
| 4,038,762 | 8/1977 | Swan | 36/71 |

*Primary Examiner*—Patrick D. Lawson
*Attorney, Agent, or Firm*—Merriam, Marshall & Bicknell

[57] ABSTRACT

Preformed fitting pads are disclosed having a protective envelope enclosure with flowable fitting material retained therein. The enclosure is shaped and constructed to provide therein communicating reservoir and primary fitting sections constructed in operative relationship to each other, so as to selectively provide for, as desired, the deliberate transfer of flowable fitting material from or to a reservoir section or a primary fitting section, and to selectively maintain, as desired, a controllable or predetermined volume of fitting material in a primary fitting section, all without requiring that fitting material be introduced into the pad from an external source of supply or be removed from the confines of the pad. The fitting material confined in said primary fitting section provides desirable pressure-compensating support when and where needed. Footwear or ankle-covering boots are also disclosed which are designed and constructed to receive and maintain such removable fitting pads therein, and which also include therein other, separate and distinct, removable fitting pads.

26 Claims, 10 Drawing Figures

ADJUSTABLE, PRESSURE-COMPENSATING, CUSTOM FITTING PADS HAVING PREDETERMINED AMOUNT OF FITTING MATERIAL AND THEIR USE IN BOOTS

The present invention relates to fitting pads particularly suitable for use in or with a variety of boots or sports footwear, such as ski boots, which provide adjustable, proper and ready fitting, firm pressure-compensating support, and comfort to desired portions or regions of the foot of the wearer [e.g., selected side (including the ankle extremities) and front (extending from the vicinity, but not including, the arched instep to the ends of the toes) regions of the foot], and ankle-covering boots or sports footwear which include such fitting pads.

If desired, the fitting pads may be used in conjunction with rear-entry or conventional front-entry boots (e.g., ski boots), and the boots may be constructed and designed for a variety of uses (e.g., ice skates).

Furthermore, fitting pads of the invention may be used in conjunction with articles other than boots or footwear. For example, such fitting pads may be used in conjunction with cushioning structures, devices or appliances, such as sports and safety equipment, which provide protection or comfort to parts of the human body by cushioning against pressure, impact or shock.

The adjustable fitting pad of this invention has flowable fitting material therein and includes communicating, but selectively separable or partitionable, reservoir and primary fitting sections. When used, for example, in conjunction with boots, the pad provides improved, customfitting of the boot to the foot of the wearer at ambient or room temperatures, is removable from the boot, does not require, for fitting purposes, that one physically remove flowable fitting material from the confines of the already formed pad or introduce such material into the formed pad from an external source, and conveniently provides for adjustable control of a desired or predetermined volume of flowable fitting material that covers or coacts with selected or primary fitting regions of the foot. Furthermore, the reservoir section(s) of the pad selectively provide(s) added flowable fitting material, when needed, for the primary fitting section(s), and may, if desired, receive some fitting material from the primary fitting section(s). When used in boots, the reservoir section(s), for example, cover(s) the lower front region of the foot, including the toes, which region does not require flowable fitting material thereat for fitting purposes or at least does not require as much fitting material thereat; whereas, the primary fitting section(s) require(s) fitting material thereat, although a variable volume which is dependent upon the particular size and shape of the foot of the wearer.

The term "flowable," when referring to the flowable fitting material hereof, characterizes the moldable, shapeable, deformable or pressure-compensating properties of that fitting material under conditions of fitting and/or use.

The term "preformed," when referring to adjustable fitting pads hereof, refers to the presence and retention of flowable fitting material within at least part of the confines of the enclosure, and therefore does not exclude any desired or deliberate transfer of fitting material, within the enclosure, to or from a primary fitting section from or to a reservoir section thereof for fitting purposes.

Ski boots presently available generally comprise a relatively rigid outer shell which typically is molded of plastic. Disposed within the outer shell of such boots is an inner member or liner which is relatively soft and flexible, as compared to the shell. The boot also has one or more buckles or other suitable fastening means for selectively opening and closing the boot.

Rear-entry ski boots generally have a pivoting rear tongue member which pivots outwardly away from the shell to provide a rear, vertically extending opening, which accommodates or facilitates placement of the foot of the wearer into the boot. After the foot is placed in the boot from the rear, the rear tongue member is pivoted back into its closed position and is secured in place by fastening means, such as one or more buckles and associated fastening loops or cables. It should be noted that each of U.S. Pat. Nos. 3,798,799 and 3,882,561 to Alden B. Hanson and Chris A. Hanson discloses a rear-entry ski boot. The disclosure of each of those patents is hereby expressly incorporated by reference herein.

Referring to U.S. Pat. Nos. 3,798,799 and 3,882,561 in added detail, those patents disclose rear-entry ski boots having a substantially rigid, plastic outer shell, and a substantially flexible, inner liner (e.g., polyurethane foam) disposed therein. The outer surface of the liner is generally complementary to the inside surface of the outer shell. The inner surface of the liner is adapted to surround the wearer's foot, including the ankle extremities, is contoured substantially to the outer surface of the wearer's foot, and is adapted to be deformed to custom-fit the foot during the special fitting procedure disclosed therein. The liner is shaped and positioned to provide a clearance or space forming one or more cavities (herein "cavity") between its outer surface and the inner surface of the outer shell, which cavity is adapted to be substantially filled with substantially non-compressible, fitting material. The fitting material is inserted into the cavity, preferably during the course of a special custom-fitting and sizing operation, to complete the assembly. Alternatively, the fitting material may be placed in the cavity prior to the fitting operation, and simply rendered flowable during the special customfitting operation. Although the fitting material is flowable during the special conditions of the fitting operation, thereafter it solidifies or hardens to give firm support and comfort for skiing purposes.

The fitting material, as disclosed in those particular patents, does not provide a padding function, since it is substantially non-compressible during conditions of use. It does provide, however, a support function for the skier's foot and ankle, and firm contact between the foot and the outer shell of the ski boot.

The custom-fitting operation disclosed in U.S. Pat. Nos. 3,798,799 and 3,882,561 is preferably accomplished by injecting heat-flowable, thermoplastic fitting material into a cavity formed between the outer shell and the liner or into a bladder or enclosure that is positioned in the cavity, with the foot being in place within the liner. The fitting material is heated until it becomes flowable, whereupon it is introduced into the cavity or bladder. The wearer waits for the warm fitting material to cool sufficiently and consequently to solidify or harden to provide a custom-fit to the shape of the foot.

The present invention involves the use of flowable, pressure-compensating fitting material which significantly differs from the substantially non-compressible fitting material disclosed in those patents.

In accordance with the invention, a preformed, adjustable fitting pad of selected shape and construction is conveniently used, which comprises a flexible, protective envelope enclosure having confined and retained therein a predetermined volume of flowable, pressure-compensating fitting material with desirable fitting and flow characteristics. The flowable fitting material is capable of deforming to the shape of the foot at ambient or room temperatures. The fitting pad retains the flowable, pressurecompensating fitting material therein and is shaped, constructed, and adapted to be positioned in an ankle-covering boot between the boot and the foot. For example, it is adapted to be positioned between an outer shell and a flexible liner member (the term "liner" includes the use of padding means), so as to substantially or significantly fill the space or cavity provided between portions of the shell and liner member that are directly adjacent to or in direct contact with a primary fitting section of the fitting pad (in overlying and underlying relationship thereto). The fitting pad is adapted to provide and maintain a snug or firm fitting relationship with desired regions of the foot of the wearer during conditions of use while, at the same time, maintaining a high degree of comfort.

In accordance with the present invention, the adjustable fitting pad is removable from the boot and includes a shaped, flexible, protective barrier or envelope enclosure having retained therein a predetermined volume of flowable, pressure-compensating fitting material. The overall enclosure is an integral or unitary structure shaped and constructed (a) to provide within its confines at least one reservoir section and at least one communicating primary fitting section, (b) to allow confined, flowable fitting material present in the primary fitting section to flow within that section in response and conformance to continuously applied pressure exerted by the foot on that section of the fitting pad and the relief of such exerted, flowproducing pressure, and (c) to provide a reservoir section from or to which at least some flowable fitting material may be selectively transferred, as desired, within the enclosure to or from the primary fitting section. The enclosure or pad is also shaped or constructed to include means for selectively restricting or preventing the flow of flowable fitting material from the reservoir section to the primary fitting section, or vice versa, and for maintaining, after the boot is properly fitted, a desirable or controllable volume of fitting material in the primary fitting section.

Since the reservoir section of the pad is positioned over or coacts with selected regions of the foot which need or require little, if any, custom-fitting to the shape of the foot and/or pressure-compensating support during conditions of use, and the boot is shaped and constructed to provide a cavity with sufficient clearance to accommodate for the presence in the reservoir section of a varying or adjustable volume of fitting material, the reservoir section may conveniently retain or have a controllable or variable volume of fitting material, as desired or needed, without causing discomfort to the foot.

Furthermore, by deliberately transferring, within the enclosure, flowable fitting material to or from the primary fitting section from or to the reservoir section, as desired or needed, one may assure that the primary fitting section custom-fits the shape of the foot of the wearer snugly and with comfort, and provides thereat proper and ready fitting and firm pressure-compensating support to regions of the foot that need custom-fitting and pressure-compensating support. When the boot is fitted to the wearer, the cavity which accommodates the fitting section of the pad is substantially filled by that section of the pad.

Referring to the multi-sectional fitting pad in added detail, means may be provided for selectively restricting or preventing the flow of flowable fitting material from one section to the other section and for maintaining a desirable and controllable volume of fitting material in the primary fitting section. For example, one may selectively fold or roll-up at least part of the reservoir section, much as one rolls-up an end of a tube of tooth paste, as desired or needed. In that embodiment, the reservoir section has a variable length or size, and the portion of the reservoir section that may remain after such folding or rolling-up operation may be considered as being an end part or extention of the primary fitting section.

Alternatively, the communicating reservoir and primary fitting sections of the multi-sectional pad or enclosure may be interconnected by a communicating, restrictable or partitionable flow control passageway. The passageway should be positioned, shaped and constructed to be selectively opened or closed, as desired. When opened, it selectively provides for the transfer or movement therethrough of fitting material from or to the reservoir or primary fitting sections. When closed, it selectively restricts or prevents the ingress or egress of additional fitting material from one section to the other section, and maintains a desirable or controllable volume of fitting material in the primary fitting section.

The opening and closing of the restrictable passageway may be provided by a variety of adjustable, partitioning or separating, clamping means. For example, the clamping means may comprise a removable flow control clip, or an adjustable vise-like clamp which is connected to the shell of the boot.

Still further, an adjustable clamping plate may be positioned below the reservoir section and connected by an adjusting screw to the overlying shell of the boot, so that the plate may be adjusted to firmly urge the reservoir section (with fitting material) against the shell in a vise-like manner and thereby restrict or limit the flow of fitting material from the primary fitting section, through the passageway, and into the reservoir section.

Another, separate and distinct, removable, pressurecompensating fitting pad with flowable fitting material retained therein should also be disposed in ski boots so as to cover the arched instep region of the foot, an area not covered by the adjustable, pressure-compensating pads for boots specifically described above. By using such a separate instep fitting pad, one advantageously provides a fitting pad at another primary fitting region of the foot that needs pressure-compensating fitting and support during conditions of use, and, more specifically, provides effective means for maintaining flowable fitting material thereat. If that pad were not separate and distinct and were an integral or communicating part of the above referred to fitting section of the multi-sectional pad, during certain conditions of use, the flow material would flow from that instep region to lower communicating regions and not return, as needed, or not adequately return to the instep region.

The protective envelope enclosures of the abovementioned fitting pads may be formed of a variety of flexible and pliable materials which provide a protective barrier for the predetermined volume of flowable fitting material substantially sealably maintained therein, and should be substantially impervious to the flow or seepage therethrough of necessary or essential constituents or components of the confined fitting material. However, the barrier material may not be, and often is not, entirely impervious to the escape or transmission therethrough of volatile liquids, such as any residual water which may be present in the fitting material. If the closure is formed of a synthetic resinous film, the film should be flexible both at ambient room temperatures and at temperatures of use, which for ski boots is at least as low as about −20° F.

The preferred material is a heat-sealable elastomeric film formed of thermoplastic synthetic resin [e.g., a thermoplastic polyurethane film, such as MP-1880 film supplied by Stevens Elastomeric & Plastic Products, Inc.,, a subsidiary of J. P. Stevens & Co., Inc., Easthampton, Mass., or a polyester-based thermoplastic polyurethane film known as "Tuftane" TF-310, supplied by B. F. Goodrich General Products Company, Akron, Ohio].

The flowable, pressure-compensating fitting material is sealably retained within the envelope enclosure of the fitting pad and is substantially homogeneous, stable, and although viscous, flows under controlled pressure conditions during fitting and conditions of use, so as to snugly or firmly, but comfortably, fit or conform to the shape of the foot when the foot is placed in the boot, and, subsequently during skiing or other activities. At the same time, the fitting pad provides effective means for substantially filling the cavity between the adjacent or over-lying, semi-rigid outer shell of a ski boot and adjacent or underlying, substantially flexible liner of the boot and/or the foot. The flexible liner has an inner surface contoured substantially to the outer surface of the foot.

Referring next to the pressure-compensating fitting material retained in the primary fitting section(s) of the adjustable fitting pad and the separate instep fitting pad, it is flowable or formable, will conform or deform to an irregular shape, will substantially retain that shape when relieved of pressure, and does not "sag" or slump significantly upon storage at ambient temperatures. The fitting material provides positive foot control for the wearer. The shape of the fitting material may be changed, for example, by the application of continuously applied pressure or shear stress that exceeds some desired minimum level. After the yield point of the fitting material is reached, it flows under shear stress. In this respect, the fitting material responds in a manner generally expected of a liquid.

The flowable fitting material generally is a thermoplastic composition. It provides controllable, pressure-compensating support. It is flowable during fitting and conditions of use about the adjacent or underlying portion of the foot, so as to be capable of essentially assuming or conforming to or snugly or firmly fitting its shape to that of the foot in an effective, but comfortable manner. It gives desired firm support and comfort for skiing or other intended purposes. It is a viscous material and generally may be considered as being highly viscous, and should not significantly or substantially change its volume responsive to ambient temperatures or ambient temperature changes.

When the flowable fitting material is confined within an envelope enclosure and the resultant pad is confined in a boot, during conditions of use the fitting material should be resistant to flow in response to instantaneously applied pressure, and should flow in response to continuously applied pressure to provide some pressure on portions of the foot that can best withstand it and to allow portions of the foot to at least momentarily move away from pressure. The confined fitting material should undergo flow and deformation away from the areas of highest pressure, but should not flow away from those portions of the foot which require support or flow out of desired locations to provide an uncomfortable fit.

A preferred flowable fitting material is disclosed in pending U.S. application Ser. No. 723,981 of Jack C. Swan, Jr., filed Sept. 16, 1976, and includes a viscous, flowable, predominant continuous phase essentially consisting of wax and oil, preferably a petroleum-based wax and oil, and a discontinuous, substantially uniformly distributed phase of discrete, lightweight, sturdy microbeads, such as expanded monocellular microspheres of thermoplastic resinous material (see, for example, U.S. Pat. No. 3,615,972 to Morehouse, et al.) formed, for example, of vinylidene chlorideacrylonitrile copolymer.

More particularly, the preferred flowable fitting material, as disclosed in said application Ser. No. 723,981, is characterized by having a predominant, substantially homogeneous, substantially stable, viscous, flowable, continuous phase essentially consisting of wax and oil, and having substantially uniformly distributed therethrough, a discontinuous phase of discrete, lightweight, sturdy microbeads. The wax and oil phase is present in an amount sufficient (a) to more than merely thinly coat substantially the entire outer surface of essentially each of the microbeads or to more then merely form a thin film over the surface of essentially each of the microbeads, and (b) to provided a volume that is substantially more than the volume of the interstitial spaces of the quantity of microbeads alone. The preferred fitting material is further characterized by having a substantially homogeneous consistency and not substantially changing in volume responsive to ambient temperatures or ambient temperature changes, being resistant to sag, flowing in response and conformance to continuously applied pressure, and, when confined during conditions of use, being resistant to flow in response to instantaneously applied pressure.

The disclosure of said application Ser. No. 723,981 is hereby expressly incorporated by reference herein.

Other suitable flowable fitting materials are disclosed, for example, in U.S. Pat. Nos. 3,237,319 and 3,635,849 of Alden W. Hanson.

In the accompanying diagrammatic drawings.

For purposes of convenience, the same number will be used to identify the same or similar elements or parts which appear in the different views of the drawings.

Figure 2:
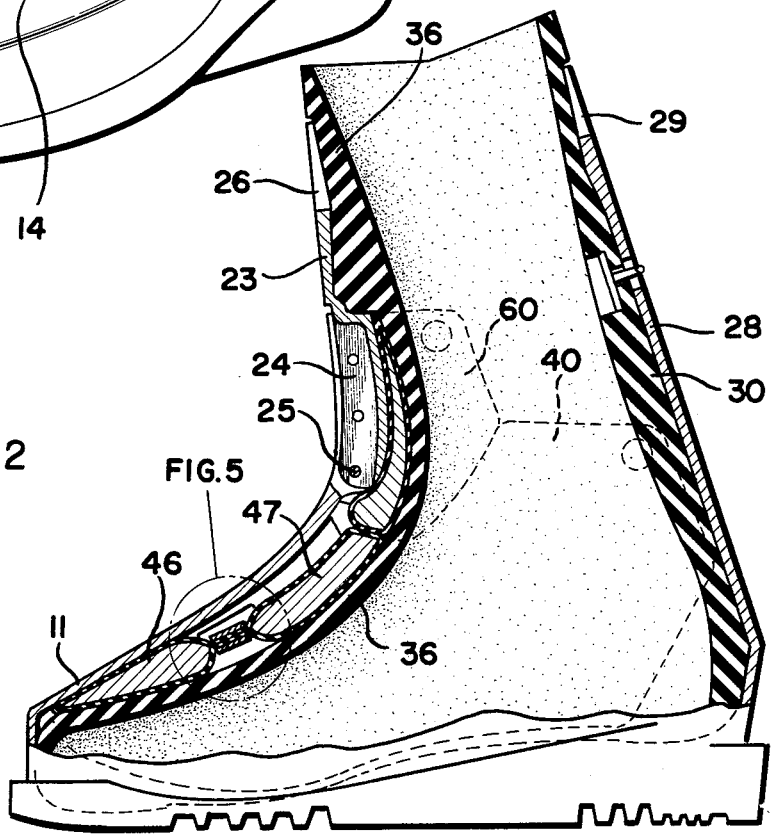
FIG. 2 is a side, partial sectional view of the ski boot shown in FIG. 1.
Figure 3:
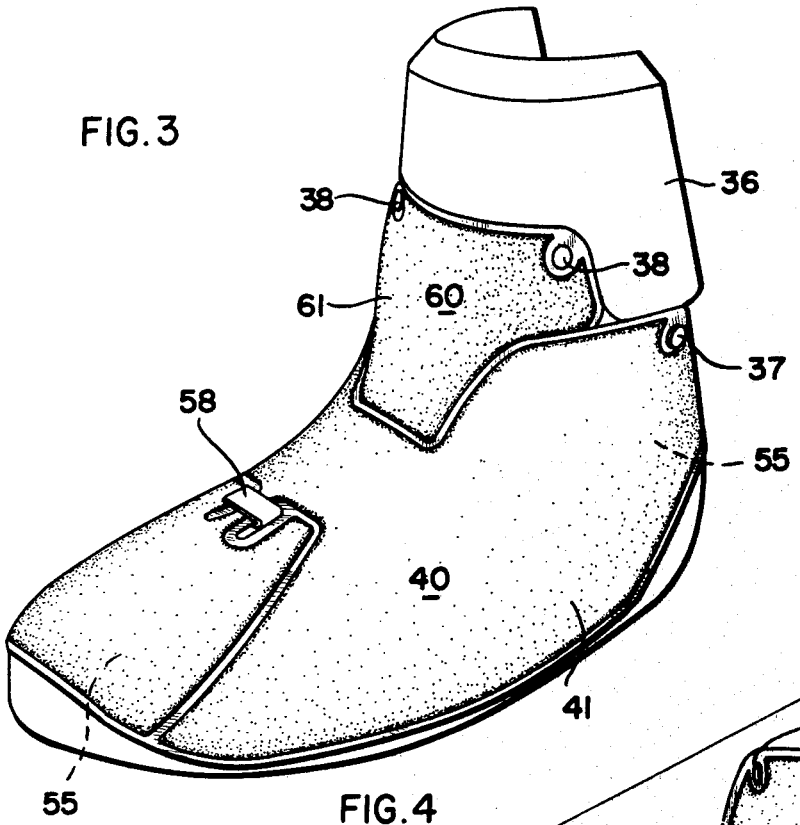
FIG. 3 is a front perspective view of the ski boot of FIGS. 1 and 2 showing a removable fitting pad assembly comprising an adjustable, multi-sectional fitting pad with a removable (and reassertable), partitioning or separating, flow control clip operatively associated therwith, and a separate, removable, instep fitting pad positioned in place on the removable, inner flexible liner member.
Figure 4:
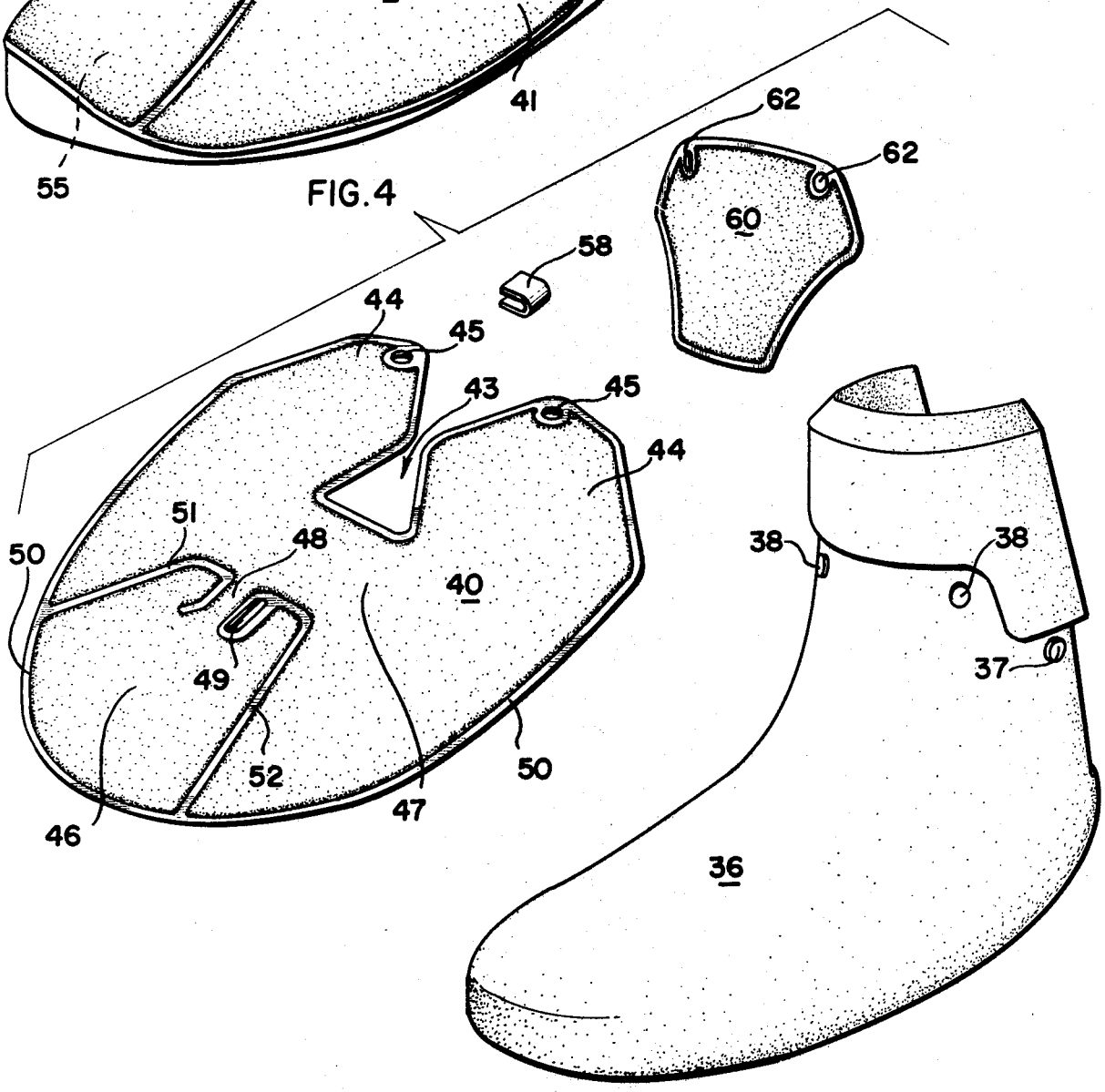
FIG. 4 is similar to FIG. 3, but shows components of the fitting pad assembly in exploded relationship with respect to the inner flexible liner member.
Figure 5:
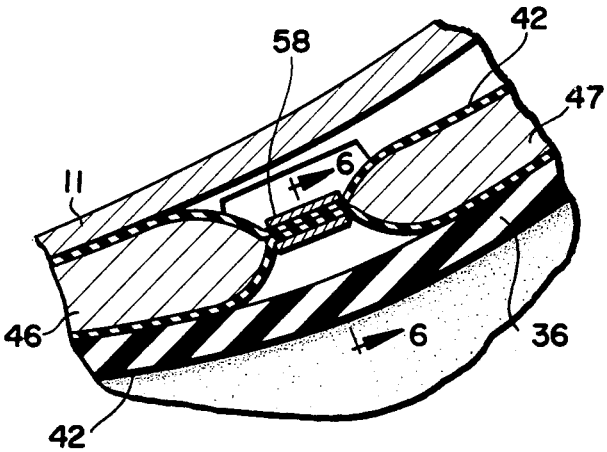
FIG. 5 is an enlarged, fragmentary, sectional view showing the encircled section shown in FIG. 2, and showing the removable, flow control clip operatively associated with the adjustable, multi-sectional fitting pad.
Figure 6:
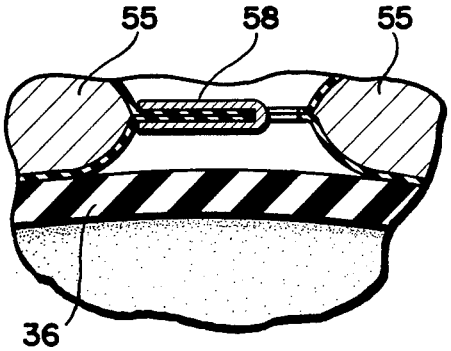
FIG. 6 is an enlarged, fragmentary, sectional view viewed along the line 6—6 of FIG. 5.

Referring to the fitting pad assembly shown in FIGS. 2–6, the shaped, adjustable pressure-compensating fitting pad 40 thereof comprises a flexible, protective bladder or envelope enclosure 41 with a predetermined volume of flowable, pressure-compensating fitting material 55 sealably retained therein. The envelope enclosure 41 is constructed of flexible material and desirably is formed of a flexible and pliable, thermoplastic resinous film 42 that is heat-sealed. As shown in FIG. 4, the fitting pad 40 is bifurcated, and has two, similarly-shaped, upper legs 44 with an opening 43 therebetween. Although the opening 43 may have a variety of appropriate shapes, it is shown herein as having an hourglass configuration. The ends of the legs 44 have locating holes 45 which should be positioned on the pair of buttons 37 of the removable, rear-entry, flexible liner member 36, thereby facilitating the appropriate positioning of the legs 44 of the pad 40, as well as the remainder of the pad, in place on a recessed portion of the liner 36. If desired, the buttons 37 may be shaped and constructed to be snapped into the locating holes 45.

More particularly, the enclosure 41 is multisectional. It includes therein a reservoir section 46 and a communicating primary fitting section 47 interconnected by a communicating, but restrictable or partitionable, narrow passageway 48. Each of these sections includes an adjustable or controllable volume of flowable fitting material 55. As shown in FIG. 4, a slot or opening 49 is positioned in the vicinity of the restrictable passageway 48 and is shaped to receive a removable, U-shaped flow control clip 58 in the manner shown in FIGS. 2, 3, 5 and 6. The clip 58 may be selectively inserted into the slot 49 with the intermediate or arcuate portion of the clip positioned in the slot. When so inserted in the slot 49, the opposed sides of the clip 58 and shaped and constructed to securely clamp or close the passageway (see FIGS. 2, 3, 5 and 6), thereby selectively restricting or preventing the flow of flowable fitting material 55 therethrough from one section to the other by closing or partitioning the interconnecting passageway 48 and separating the communicating reservoir section 46 and primary fitting section 47. and maintaining a predeterminable, selectable or controllable volume of fitting material 55 in the primary fitting section. FIGS. 2, 3, 5 and 6 show the flow control clip 58 positioned in place and restricting or preventing the flow of fitting material 55 from one section to the other.

The peripheral edges 50 of the enclosure 41 and the L-shaped lines 51 and 52 thereof, shown in FIG. 4, at least in part define boundaries of the reservoir and primary fitting sections. Those edges and lines, as well as the clip receiving slot 49, are formed by heat-sealing thereat upper and lower sheets of the film 42.

Figure 1:
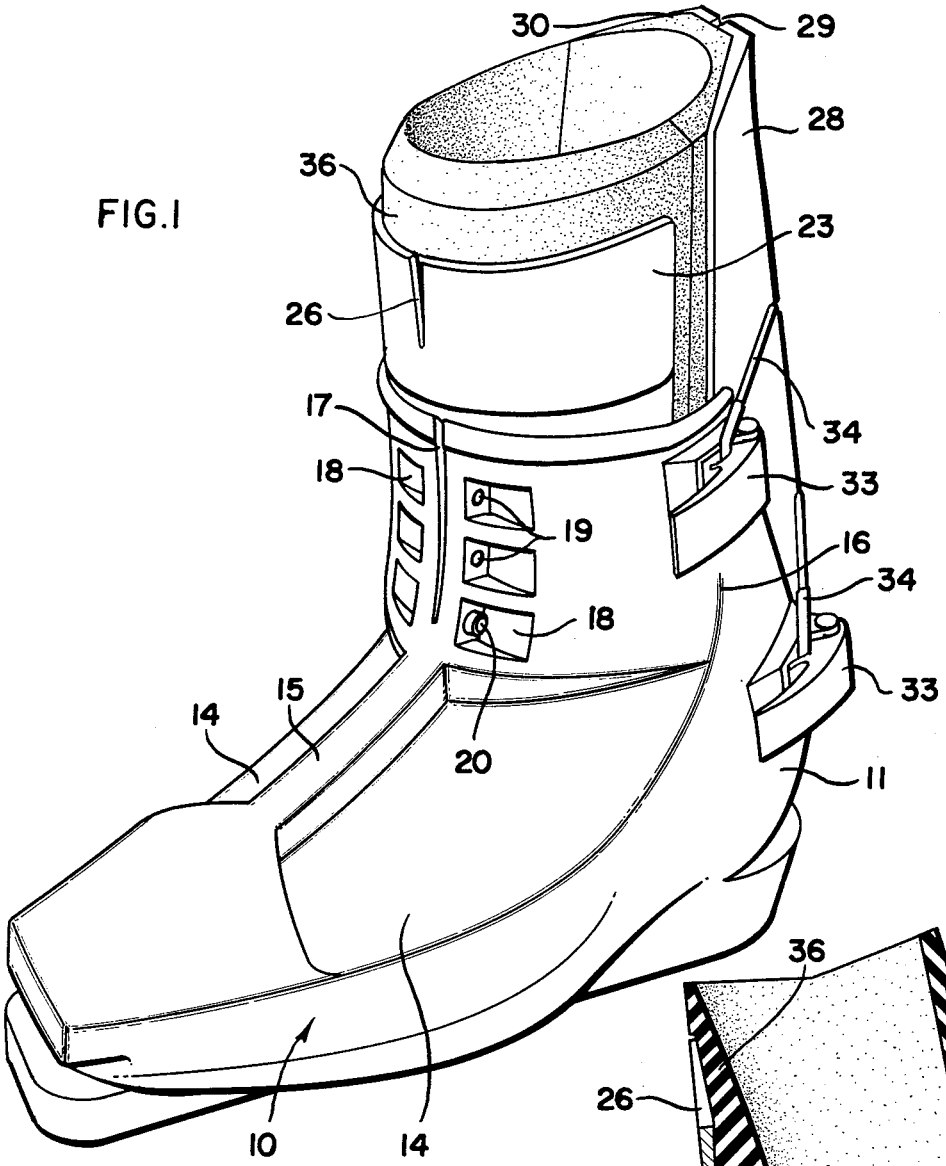
FIG. 1 is a perspective view of an assembled rearentry ski boot having a substantially rigid outer shell, and a removable, inner flexible liner member. A fitting pad assembly is positioned between the shell and liner member, but is not shown in FIG. 1.

The fitting pad 40 is shaped so as to be positioned over selected front and side regions of the liner 36 (and the foot) in the manner shown in FIGS. 2 and 3. The inner surface of the liner 36 (not shown) is contoured substantially to the outer surface of a wearer's foot. The liner 36 and overlying fitting pad 40 are positioned in place in the substantially or relatively rigid, outer ski boot shell 11 of the ski boot 10 shown in FIGS. 1 and 2, so that the primary fitting section 47 of fitting pad 40 significantly or substantially fills the space or cavity between the adjacent, overlying and underlying regions of the outer shell 11 and the inner, flexible liner member 36, respectively (see FIGS. 2 and 5). Moreover, the shell 11 is constructed to provide a cavity which is shaped so as to fully accommodate the variable volume of fitting material that may be present in the reservoir section 46 of the pad 40 (see FIGS. 2, 5 and 6).

FIGS. 2 to 4 also show a separate, upper, pressure-compensating, instep fitting pad 60 which is shaped to be positioned on the recessed liner member 36 and in the opening 43 provided between the legs 44 of the fitting pad 40. When so positioned, the pad 60 covers the arched instep region of the foot. The instep pad 60 has an envelope enclosure 61 with flowable, pressure-compensating fitting material 55 sealably retained therein. The enclosure 61 is formed of the same flexible thermoplastic film used in forming the fitting pad 40. The peripheral edges of the pad are heatsealed, thereby retaining therein the flowable, pressure-compensating fitting material 55. The upper end of the instep fitting pad 60 has a pair of locating holes 62 which should be positioned on the pair of buttons 38 of the flexible liner member 36, thereby facilitating the positioning of the pad 60 in place on a recessed portion of the liner 36. If desired, the buttons 38 may be shaped and constructed to be snapped into the locating holes 62.

When the primary fitting section 47 of the pad 40 has an appropriate volume of fitting material in it, so as to provide proper fitting for a particular skier, and its restrictable passageway 48 is closed, and both of the pads 40 and 60 and the underlying liner 36 are positioned in place in the boot 10, the foot of the skier is placed in the boot, the controllable or adjustable volume of pressure-compensating fitting material 55 present in the primary fitting section 47 of the pad 40 flows therein at ambient temperatures to conform to the contour or shape of the skier's foot covered by that section and to essentially fill the space or cavity provided for that section, thereby providing and thereafter maintaining a snug or firm, but comfortable, pressure-compensating fit. Furthermore, the flowable fitting material 55 in the instep fitting pad 60 flows therein in a similar manner to accommodate properly the shape of the instep region of the foot.

The assembled rear-entry ski boot 10 shown in FIGS. 1 and 2 includes a substantially rigid, outer plastic shell 11. As shown in FIG. 1, a front part of the shell 11 has a pair of similarly-shaped depressed regions 14 which slope downwardly from their respective outer sides toward an intermediate rib 15. Those depressions provide for the use of less plastic material, and the intermediate rib provides desirable structural strength at that region of the boot. The shell 11 has a pair of vertically extending crease lines 16 of desired length positioned at the sides thereof. FIG. 1 shows only one of those crease lines. The front of the shell has a vertically extending slit 17 positioned above the rib 15. As shown in FIG. 2, the slit 17 receives a vertically extending plastic fin 24, which is connected to the base of the plastic tab 23, and projects therefrom in a substantially perpendicular manner. As explained in added detail later below, the length of the slit 29 is adjustable, so that a skier may adjust the flex in the boot 10 to an amount desired by him. As shown in FIG. 1, the upper end of the base of the tab 23 has a vertically extending slit 26, which provides flexibility to that region of the boot.

At the front of the boot 10, as shown in FIG. 1, a plurality of opposed, similarly-shaped, aligned pairs of recesses 18 are positioned in the vicinity of each of the sides of the slit 17. Each pair of recesses 18 has aligned holes 19, which, in turn, are aligned with the intermediate, vertically spaced-apart holes 25 in the fin 24 of the tab 23 (see FIG. 2). Adjustable fastening means are shown in FIG. 1 connecting the lowermost aligned holes. The fastening means may include, for example, a threaded screw (not shown) which extends through the aligned holes and is retained in place by means of a threaded, adjustable locking nut 20. By positioning the threaded screw and locking nut in place in any one of the three sets of aligned holes, the skier may select or change the amount of flex in the boot to provide variable flex characteristics, much in the manner provided by the ski boot disclosed in U.S. Pat. No. 3,848,347 to Alden B. Hanson and Chris A. Hanson.

A plastic, pivoting tongue member 28 is positioned at the rear of the vertically extending openings of the shell 11 and liner 36, and has a flexible liner member 30 which pivots therewith. The upper end of the tongue 28 has a vertically extending slit 29. which provides desirable flexibility thereat. The tongue 28 and its liner 30 selectively pivot, together, from the base of the tongue (at or near the vicinity of the heel of the boot) outwardly away from the shell 11 of the boot and liner member 36, to provide a rear, vertically extending opening for entry of the foot into the boot 10, and selectively pivots back to a closed position. As shown in FIG. 1, the closed tongue 28 is secured in place in a closed position by appropriate fastening means, such as provided by a pair of buckles 33 which selectively secure a pair of cables 34 under tension. Such fastening means are disclosed in U.S. Pat. Nos. 3,945,135 and 3,936,959 to Alden B. Hanson and Chris A. Hanson, and the disclosures of those patents are hereby expressly incorporated by reference herein.

Figure 7:
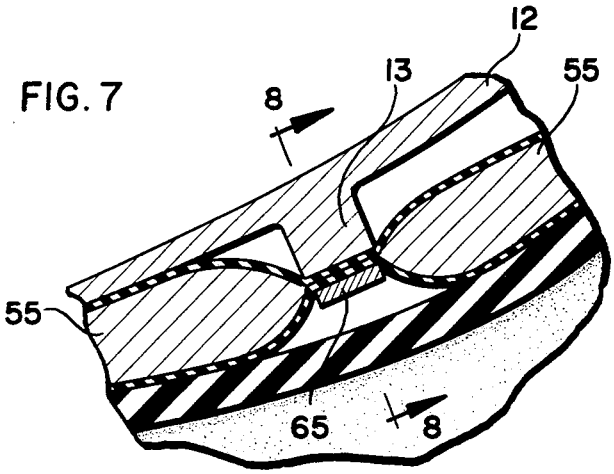
FIG. 7 is an enlarged, fragmentary, sectional view similar to FIG. 5, but showing the adjustable, multi-sectional fitting pad operatively associated with a separate, adjustable clamp which is connected to the shell of a modified boot.
Figure 8:
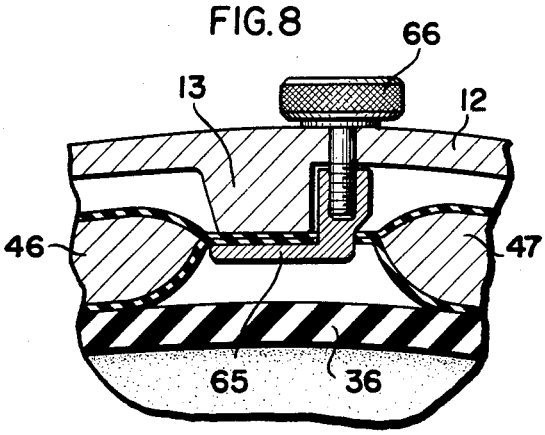
FIG. 8 is an enlarged, fragmentary, sectional view, similar to FIG. 6, but viewed along the line 8-8 of FIG. 7.

FIGS. 7 and 8 show an alternative use of the fitting pad 40 shown in FIGS. 2–6 and described above. More particularly, FIGS. 7 and 8 differ from FIGS. 5 and 6, respectively, in that the restrictable interconnecting passageway 48 of the pad 40 is closed or restricted by means of an adjustable, removable, L-shaped clamp 65 having a threaded hole therein, instead of the removable clip 58. The clamp 65 is connected to a modified shell 12 of a ski boot by means of a removable, threaded adjusting screw 66. The clamp 65 is positioned in the slot 49 of the pad 40 (see FIG. 8), and the upper wall of the narrow or restricted passageway 48 is positioned in bearing contact with a protuberance 13 which extends downwardly from the inner side of the shell 12 of the boot. The adjusting screw 66 is then tightened, so as to firmly close the passageway.

The instep fitting pad 60 is used in conjunction with the fitting pad shown in FIGS. 7 and 8.

Figure 9:
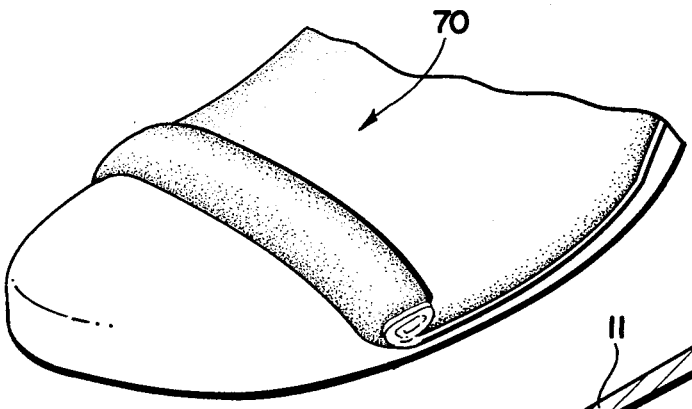
FIG. 9 is a front perspective view showing a lower portion of a flexible liner member and a lower portion of another embodiment of an adjustable fitting pad; and, FIG. 10 is an enlarged, side, fragmentary, sectional view showing the adjustable fitting pad of FIG. 9 disposed in the boot between the shell and liner member.
Figure 10:
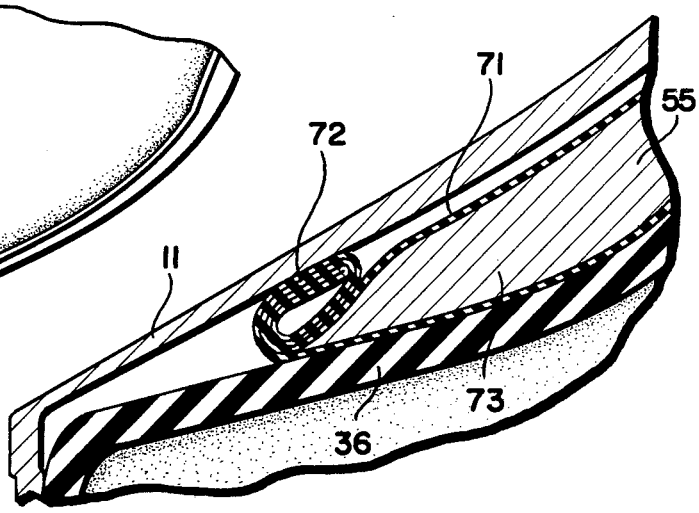

FIGS. 9 and 10 show another embodiment of an adjustable fitting pad. The fitting pad 70 shown therein has an envelope enclosure 71 with fitting material 55 therein. The enclosure 71 differs from the enclosure 41 of the fitting pad 40 shown in FIGS. 3 and 4 in that the heat-sealed, L-shaped lines 51 and 52, which define adjacent boundaries of the reservoir and primary fitting sections of the pad 40, and the slot 49 thereof are not present. The fitting pad 70 has communicating reservoir and primary fitting sections 72 and 73 with a restrictable interconnecting passageway which extends entirely across the width of the pad, and may be positioned, as desired, along the length of the pad. Accordingly, the fitting pad 70 may be termed as being multisectional. The reservoir section 72 of the fitting pad 70 may be wholly or partly folded or rolled-up, as desired, much as one rolls-up the end of a tooth paste tube, to shorten the pad 70 or shorten and/or close all or part of the reservoir section. The reservoir section, which may be or remain partly or wholly unfolded or not rolled-up, may be termed as being an extension of the primary fitting section 73.

The instep fitting pad 60 is used in conjunction with the fitting pad 70 shown in FIGS. 9 and 10.

The foregoing detailed description has been given for clearness and understanding only, and the forms of the invention shown and described therein are to be considered only as illustrative, and no unnecessary limitations should be understood therefrom, as modifications will be obvious to those skilled in the art without departure from the spirit of the invention or the scope of the appended claims.

What is claimed is:

1. An adjustable, multi-sectional, pressure-compensating fitting pad of desired shape and size, which comprises a multi-sectional, shaped, flexible, protective enclosure having retained therein a predetermined volume of flowable, pressure-compensating fitting material, which, together, provide an adjustable, multi-sectional, pressure-compensating fitting pad, said multi-sectional enclosure being shaped and constructed to provide therein a reservoir section and at least one communicating primary fitting section, including interconnecting restrictable flow control passageway means, to allow confined fitting material in said primary fitting section to flow therein in response and conformance to continuously applied pressure exerted on that section of the fitting pad and the relief of such exerted, flow-producing pressure, and to provide a reservoir section from or to which at least some flowable fitting material may be selectively transferred, as desired, within the enclosure to or from said primary fitting section through said passageway means, said passageway means being positioned, shaped and constructed to be selectively opened, to provide for said transfer of fitting material from or to said reservoir or fitting sections, or closed, as desired, by separating or partitioning means, said closing of the flow control passageway means thereby selectively restricts or prevents the ingress or egress of flowable fitting material from one section to the other partitioned or separated section and maintains a desired or controlled volume of fitting material in said primary fitting section.

2. The pressure-compensating fitting pad of claim 1, wherein the closing of the restrictable flow control passageway means is provided by means of selectively folding or rolling-up at least part of the reservoir section.

3. The pressure-compensating fitting pad of claim 1, wherein said pad includes separating or partitioning, clamping means operatively associated therewith.

4. The pressure-compensating fitting pad of claim 3, wherein said separating or partitioning, clamping means comprise a removable flow control clip.

5. The pressure-compensating fitting pad of claim 1, wherein said enclosure is formed of thermoplastic elastomeric film which is heat-sealed.

6. The pressure-compensating fitting pad of claim 1, wherein said flowable fitting material is characterized by a predominant, substantially homogeneous, substantially stable, viscous, flowable, continuous phase essentially consisting of wax and oil, and having substantially uniformly distributed therethrough, a discontinuous phase of discrete, lightweight, sturdy microbeads, said wax and oil phase is present in an amount sufficient (a) to more than merely thinly coat substantially the entire outer surface of essentially each of said microbeads or to more than merely form a thin film over the surface of essentially each of said microbeads, and (b) to provide a volume that is substantially more than the volume of the interstitial spaces of the quantity of micro-beads alone, and said fitting material is further characterized by having a substantially homogeneous consistency and not substantially changing in volume responsive to ambient temperatures or ambient temperature changes, being resistant to sag, flowing in response and conformance to continuously applied pressure, and, when confined during conditions of use, being resistant to flow in response to instantaneously applied pressure.

7. In a boot that covers the ankle of the wearer, the improvement comprising providing in combination with and disposed and positioned in said boot along selected portions thereof, including selected front and side portions, including the ankle, of the foot, an adjustable, removable, pressure-compensating fitting pad having a fitting portion which substantially assumes the shape of selected portions of the foot covered thereby and provides proper, controllable and ready fitting, firm support and comfort to selected portions of the foot, and which comprises a shaped, flexible, protective enclosure having retained therein a predetermined volume of flowable, pressure-compensating fitting material, which, together, provide an adjustable, pressure-compensating fitting pad, said enclosure being shaped and constructed to provide therein a reservoir section and at least one communicating primary fitting section, to allow confined fitting material in said primary fitting section to flow therein in response and conformance to continuously applied pressure exerted on that section of the fitting pad and the relief of such exerted, flow-producing pressure, and to provide a reservoir section from or to which at least some flowable fitting material may be selectively transferred, as desired, within the enclosure to or from said primary fitting section, and including means for selectively restricting or preventing the flow of flowable fitting material from one section to the other section and maintaining a desired or controllable volume of fitting material in said primary fitting section.

8. The improved boot of claim 7, wherein the selective restricting or preventing of the flow of flowable fitting material to or from the primary fitting section from or to the reservoir section is provided by means of selectively folding or rolling-up at least part of the reservoir section.

9. The improved boot claim 7, wherein said pad is multi-sectional in that the communicating reservoir and primary fitting sections of the enclosure are inter-connected by a restrictable flow control passageway, which passageway is positioned, shaped and constructed to be selectively opened, to provide for said transfer of fitting material from or to said reservoir or primary fitting sections, or closed, as desired, by separating or partitioning means, said closing of the flow control passageway thereby selectively restricts or prevents the ingress or egress of flowable fitting material from one section to the other section and maintains a desired or controlled volume of fitting material in said primary fitting section.

10. The improved boot of claim 9, wherein said pad includes separating or partitioning, clamping means operatively associated therewith.

11. The improved boot of claim 9, wherein said pad includes separating or partitioning, clamping means in the form of a removable flow control clip operatively associated therewith.

12. The improved boot of claim 9, wherein said pad includes adjustable, separating or partitioning, clamping means operatively associated therewith and connected to the shell of the boot.

13. The improved boot of claim 7, wherein said enclosure is formed of thermoplastic elastomeric film which is heat-sealed.

14. The improved boot of claim 7, wherein said flowable fitting material is characterized by a predominant, substantially homogeneous, substantially stable, viscous, flowable, continuous phase essentially consisting of wax and oil, and having substantially uniformly distributed therethrough, a discontinuous phase of discrete, lightweight, sturdy microbeads, said wax and oil phase is present in an amount sufficient (a) to more than merely thinly coat substantially the entire outer surface of essentially each of said microbeads or to more than merely form a thin film over the surface of essentially each of said microbeads, and (b) to provide a volume that is substantially more than the volume of the interstitial spaces of the quantity of microbeads alone, and said fitting material is further characterized by having a substantially homogeneous consistency and not substantially changing in volume responsive to ambient temperatures or ambient temperature changes, being resistant to sag, flowing in response and conformance to continuously applied pressure, and, when confined during conditions of use, being resistant to flow in response to instantaneously applied pressure.

15. The improved boot of claim 7, wherein said boot is a rear-entry boot.

16. The improved boot of claim 7, wherein a separate and distinct, pressure-compensating, fitting pad with flowable fitting material retained therein is also disposed in said boot and is positioned, shaped and constructed to cover the arched instep region of the foot and provide thereat proper and ready fitting, firm support and comfort.

17. A ski boot, which comprises:

a substantially rigid outer shell, a flexible liner member disposed within said shell and having wall means with an inner surface and an outer surface, and constructed to conform substantially to the contour of a wearer's foot, said flexible liner member having at least one cavity associated with said outer surface thereof, whereby space or clearance is provided between said outer surface of the liner member and said outer shell, said space or clearance being shaped and of a size to fully receive an adjustable, removable, pressure-compensating fitting pad which provides proper, controllable and ready fitting, firm support and comfort to selected regions of the foot, including selected front and side regions, including the ankle, said adjustable fitting pad comprising a shaped, flexible protective enclosure having retained therein a predetermined volume of flowable, pressure-compensating fitting material, which, together, provide an adjustable, pressure-compensating fitting pad, said enclosure being shaped and constructed to provide therein a reservoir section and at least one communicating primary fitting section, to allow confined fitting material in said primary fitting section to flow therein in response and conformance to continuously applied pressure exerted by the foot on that section of the fitting pad and the relief of such exerted, flow-producing pressure, and to provide a reservoir section from or to which at least some flowable fitting material may be selectively transferred, as desired, within the enclosure to or from said primary fitting section, and including means for selectively restricting or preventing the flow of flowable fitting material from one section to the other section and maintaining a desired or controllable volume of fitting material in said primary fitting section, said ski boot being constructed so that upon placement of the foot to be fitted into said flexible liner member, the fitting material selectively present in at least said primary fitting section flows and is deformed, so as to place said flexible liner member into snug, but comfortable, fitting relationship with selected regions of the foot and to maintain such relationship during the wearing of the ski boot.

18. The ski boot of claim 17, wherein the selective restricting or preventing of the flow of flowable fitting material to or from the primary fitting section from or to the reservoir section is provided by means of selectively folding or rolling-up at least part of the reservoir section.

19. The ski boot of claim 17, wherein said pad is multi-sectional in that the communicating reservoir and primary fitting sections of the enclosure are interconnected by a restrictable flow control passageway, which passageway is positioned, shaped and constructed to be selectively opened, to provide for said transfer of fitting material from or to said reservoir or primary fitting sections, or closed, as desired, by separating or partitioning means, said closing of the flow control passageway thereby selectively restricts or prevents the ingress or egress of flowable fitting material from one section to the other section and maintains a desired or controllable volume of fitting material in said primary fitting section.

20. The ski boot of claim 19, wherein said pad includes separating or partitioning, clamping means operatively associated therewith.

21. The ski boot of claim 19, wherein said pad includes separating or partitioning, clamping means in the form of a removable flow control clip operatively associated therewith.

22. The ski boot of claim 19, wherein said pad includes adjustable, separating or partitioning, clamping means operatively associated therewith and connected to the shell of the ski boot.

23. The ski boot of claim 17, wherein said enclosure is formed of thermoplastic elastomeric film which is heat-sealed and thereby retains the fitting material in said enclosure.

24. The ski boot of claim 17, wherein said flowable fitting material is characterized by a predominant, substantially homogeneous, substantially stable, viscous, flowable, continuous phase essentially consisting of wax and oil, and having substantially uniformly distributed therethrough, a discontinous phase of discrete, lightweight, sturdy microbeads, said wax and oil phase is present in an amount sufficient (a) to more than merely thinly coat substantially the entire outer surface of essentially each of said microbeads or to more than merely form a thin film over the surface of essentially each of said microbeads, and (b) to provide a volume that is substantially more than the volume of the interstitial spaces of the quantity of microbeads alone, and said fitting material is further characterized by having a substantially homogeneous consistency and not substantially changing in volume responsive to ambient temperatures or ambient temperature changes, being resistant to sag, flowing in response and conformance to continuously applied pressure, and, when confined during conditions of use, being resistant to flow in response to instantaneously applied pressure.

25. The ski boot of claim 17, whrein said ski boot is a rear-entry ski boot.

26. A ski boot of claim 17, wherein said ski boot includes a separate and distinct, removable, pressure-compensating fitting pad with flowable fitting material retained therein, which is also disposed in said ski boot and is positioned, shaped and constructed to cover the arched instep region of the foot and provide thereat proper and ready fitting, firm support and comfort.

* * * * *